US006007974A

United States Patent [19]

Begley et al.

[11] Patent Number: 6,007,974

[45] **Date of Patent: *Dec. 28, 1999**

[54] SILVER HALIDE ELEMENT CONTAINING TRIAZOLE INHIBITORS

[75] Inventors: William J. Begley, Webster; Frank D. Coms; Teh-Hsuan Chen, both of Fairport; Donald Singleton, Jr., Olcott, all of N.Y.

[73] Assignee: Eastman Kodak Company, Rochester, N.Y.

[ * ] Notice: This patent is subject to a terminal disclaimer.

[21] Appl. No.: 09/020,117

[22] Filed: Feb. 6, 1998

Related U.S. Application Data

[63] Continuation-in-part of application No. 08/733,619, Oct. 17, 1996, abandoned.

[51] Int. Cl.[6] ..... G03C 1/08; G03C 7/26; G03C 7/32

[52] U.S. Cl. ..... 430/544; 430/553; 430/555; 430/557; 430/558; 430/955; 430/957

[58] Field of Search ..... 430/544, 553, 430/557, 555, 558, 957, 955

[56] References Cited

U.S. PATENT DOCUMENTS

| | | | |
|---|---|---|---|
| 3,617,291 | 11/1971 | Sawdey | 430/544 |
| 4,477,563 | 10/1984 | Ichijima et al. | 430/544 |
| 5,356,764 | 10/1994 | Szajewski et al. | 430/505 |
| 5,759,757 | 6/1998 | Begley et al. | 430/505 |

FOREIGN PATENT DOCUMENTS

| | | |
|---|---|---|
| 0 320 691 | 6/1989 | European Pat. Off. . |
| 0 349 332 | 1/1990 | European Pat. Off. . |
| 0 452 883 | 10/1991 | European Pat. Off. . |
| 0 657 776 | 6/1995 | European Pat. Off. . |
| 1382861 | 2/1975 | United Kingdom . |

OTHER PUBLICATIONS

Patent Abstracts of Japan, vol. 012, No. 406 (P–777), Oct. 24, 1988 & JP 63 144353 A, Jun. 16, 1988.

*Primary Examiner*—Geraldine Letscher
*Attorney, Agent, or Firm*—Sarah Meeks Roberts

[57] ABSTRACT

This invention relates to a photographic element comprising a support having situated thereon at least one silver halide emulsion layer, the element further containing an image modifying coupler which upon reaction with oxidized color developing agent during processing forms a dye, said image modifying coupler represented by the formula wherein COUP is a photographic coupler moiety;

$T^1$ is a timing or linking group;

$R^1$ and $R^2$ are independently selected from a halide atom, or an aliphatic, carbocyclic, heterocyclic, carbamoyl, sulfamoyl, carbonamido, sulfonamido, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group; and n is selected from 0, 1 or 2. More particularly this invention relates to a photographic element containing the above image modifying coupler wherein n is 0 and $R^1$ and $R^2$ are independently represented by the formula:

$$^{**}\text{—}(Z)_m\text{-}(X)_i\text{-}R^3$$

** point of attachment to triazole moiety wherein;

Z is an aliphatic, carbocyclic, or heterocyclic group.

30 Claims, No Drawings

SILVER HALIDE ELEMENT CONTAINING TRIAZOLE INHIBITORS

CROSS-REFERENCE TO RELATED APPLICATIONS

This is a continuation-in-part application of Ser. No. 08/733,619, filed Oct. 17, 1996, now abandoned entitled "Silver Halide Element Containing Triazole Inhibitors" by Begley et al.

FIELD OF THE INVENTION

This invention relates to development inhibitor releasing couplers and silver halide photographic elements containing such couplers.

BACKGROUND OF THE INVENTION

Various ways are recognized in the photographic industry for releasing a photographic inhibitor from a coupler in a photographic silver halide material and process. Release can be indirect through a linking or timing group or it can be direct, for example, upon reaction of the coupler with oxidized color developing agent during processing. Image-modifying couplers that release photographic inhibitors directly from the coupler are preferred in the photographic industry because manufacturing such couplers is easier, faster and less costly. However, many times direct release couplers, due to their inflexibility with regard to timing of release, are not practical for and effective at providing desired effects such as reduction of gradation, production of a finer color grain, improvement of sharpness through the so-called edge effect and improvement of color purity and color brilliance through inter-image effects. In this connection, reference is made to the article by C. R. Barr, J. R. Thirtle and P. W. Vittum entitled "Development-Inhibitor-Releasing (DIR) Couplers in Color Photography" in Photographic Science and Engineering 13, 74(1969).

The problem of timing of release has been addressed through the use of timing groups such as described in U.S. Pat. Nos. 4,248,962, 4,409,323 and 4,861,701. European Patent Applications 0 499 279 and 0 438 129 describe photographic compounds having a heterocyclic timing nucleus attached to a coupler moiety through an —O—C(O)— or —$OCH_2$— group, or other group capable of releasing the heterocyclic timing nucleus by electron transfer down an unconjugated chain. However, the use of timing groups can create other problems. For example, many couplers have little flexibility in their rate of release of a PUG, or in their synthetic design, as they are limited by the presence of a particular first timing or linking group, particularly with regard to substituents on such groups. More importantly, though, some couplers exhibit poor stability when stored for prolonged periods under tropical conditions. Thus, they are of limited practical value in today's photographic industry.

Triazoles have been described for use as development inhibitors and have been utilized in DIR couplers, see for example U.S. Pat. Nos. 5,200,306, 5,360,709, 5,306,607, 5,380,633 and 5,270,157. However, the particularly useful compounds of this invention have not been utilized or suggested.

Therefore, a need has existed for a photographic coupler that is synthetically simple to manufacture; has the flexibility to work in a variety of situations; and that is stable when stored for prolonged periods, especially under tropical conditions. The coupler should be capable of releasing a development inhibitor, thereby providing interlayer interimage effects and increased acutance for the image produced upon processing photographic material containing the coupler.

SUMMARY OF THE INVENTION

This invention provides a photographic element comprising a support having situated thereon at least one silver halide emulsion layer, the element further containing an image modifying coupler which upon reaction with oxidized color developing agent during processing forms a dye, said image modifying coupler represented by the formula

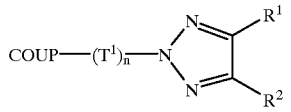

wherein

COUP is a photographic coupler moiety;

$T^1$ is a timing or linking group;

$R^1$ and $R^2$ are independently selected from a halide atom, or an aliphatic, carbocyclic, heterocyclic, carbamoyl, sulfamoyl, carbonamido, sulfonamido, acyl, sulfo, nitro, cyano, amino, alkoxy, alkoxyalkyl, aryloxy, aryloxyalkyl, arylketo, alkylketo, thioalkoxy, thioalkoxyalkyl, thioaryloxy, or thioaryloxyalkyl group; and n is selected from 0, 1 or 2. This invention more particularly provides a photographic element containing the above image modifying coupler wherein n is 0 and $R^2$ is represented by the formula $$**—(Z)_m\text{-}(X)_t\text{-}R^3$$

** point of attachment to triazole moiety wherein;

Z is an aliphatic, carbocyclic, or heterocyclic group;

X is oxygen, sulfenate, sulfinate, sulfate, sulfur, sulfonyl, sulfinyl, selenium, selenonyl, seleninyl, or [—N($R^4$)—]; and $R^3$ and $R^4$ are independently selected from hydrogen, or aliphatic, carbocyclic, heterocyclic groups, or acyl groups;

m is an integer from 0 to 10; and t is 0,1 or 2. It further provides image modifying couplers as described above.

The image modifying couplers utilized in this invention provide improved interlayer interimage effects and acutance levels in the photographic elements in which they are contained. The new couplers are synthetically simple to manufacture and are much more stable than previously known photographic inhibitor releasing couplers containing a 1,2,3-triazole moiety. They are particularly stable during storage for prolonged periods at high temperatures. Further, the image modifying couplers are capable of and more preferably utilize direct release of 1,2,3-triazole inhibitors and they provide a wide range of reactivities depending upon the particular selection of the 1,2,3-triazole inhibitor and the substituents thereon. These couplers, unlike many other untimed or unlinked DIR couplers, can deliver a development inhibitor at a distance from the point at which oxidized color developing agent reacted with the coupler.

DETAILED DESCRIPTION OF THE INVENTION

It has been surprisingly discovered that Development Inhibitor Releasing Couplers (DIRs) which comprise a triazole inhibitor moiety which is attached to the coupler moiety through the 2'-nitrogen of the triazole moiety (as shown below) are more reactive than those attached to the 1'- or 3'-nitrogens of the triazole moiety. It has further been discovered that such DIRs, when comprising specific substituents on the triazole moiety, are very stable under prolonged storage conditions.

The imaging modifying couplers of this invention are represented by the formula

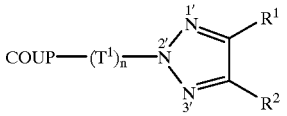

wherein COUP is a photographic coupler moiety and $T^1$ is a timing or linking group. While one of the main advantages of the image modifying couplers of this invention is that the coupler may be directly attached to the 1,2,3-triazole moiety, making the use of a timing or linking group unnecessary, an indirect attachment through a timing or linking group may be utilized. More preferably the attachment is direct. Therefore, n is selected from 0, 1 or 2 but is preferably 0. The 1'-, 2'- and 3'-nitrogen positions are as indicated. It will be appreciated that when $R^1$ and $R^2$ are the same the 1'-nitrogen and 3'-nitrogen positions are equivalent but that when $R^1$ and $R^2$ are not the same the 1'-nitrogen and 3'nitrogen positions are not equivalent.

In the photographic coupler utilized in the present invention, the coupler moiety, as represented by COUP, can be any moiety that will react with oxidized color developing agent during processing to cleave the bond between $T^1$ and the coupler moiety or the triazole moiety and the coupler moiety. The coupler moiety as described herein includes conventional coupler moieties employed to yield both colorless and colored products upon reaction with oxidized color developing agents. Both types of coupler moieties are well known to those skilled in the photographic art and are exemplified in, for example, *Research Disclosure,* September 1994, Item 36544, all published by Kenneth Mason Publications, Ltd., Dudley Annex, 12a North Street, Emsworth, Hampshire PO10 7DQ, ENGLAND.

The coupler moiety can be ballasted or unballasted, and if unballasted, the dye formed upon oxidative coupling is capable of diffusing throughout, or being washed out of, the photographic element (sometimes known as a washout coupler). The coupler can be monomeric, or it can be part of a dimeric, oligomeric or polymeric coupler, in which case more than one triazole moiety can be contained in the coupler. The coupler can also form part of a bis compound in which the triazole moiety forms part of a link between two coupler moieties.

Representative coupler moieties suitable for use in the invention are as follows:

A. Couplers which form cyan dye upon reaction with oxidized color developing agent are described in such representative patents and publications as: U.S. Pat. Nos. 2,772,162; 2,895,826; 3,002,836; 3,034,892; 2,474,293; 2,423,730; 2,367,531; 3,041,236; 4,333,999 and "Farbkuppler-eine Literaturubersicht," published in Agfa Mitteilungen, Band III, pp. 156–175 (1961), all of which are incorporated herein by reference.

Preferably such cyan dye-forming couplers are phenols and naphthols.

B. Couplers which form magenta dye upon reaction with oxidized color developing agent are described in such representative patents and publications as: U.S. Pat. Nos. 2,600,788; 2,369,489; 2,343,703; 2,311,082; 3,152,896; 3,519,429; 3,062,653; 2,908,573 and "Farbkuppler-eine Literaturubersicht," published in Agfa Mitteilungen, Band III, pp. 126–156 (1961), all of which are incorporated herein by reference.

Preferably such magenta dye-forming couplers are pyrazolones or pyrazolotriazoles.

C. Couplers which form yellow dye upon reaction with oxidized color developing agent are described in such representative patents and publications as: U.S. Pat. Nos. 2,875,057; 2,407,210; 3,265,506; 2,298,443; 3,048,194; 3,447,928 and "Farbkuppler-eine Literaturubersicht," published in Agfa Mitteilungen, Band III, pp. 112–126 (1961), all of which are incorporated herein by reference.

Preferably such yellow dye-forming couplers are acylacetamides, such as benzoylacetamides and pivaloylacetamides.

D. Couplers which form a colorless product upon reaction with oxidized color developing agent are described in such representative patents as: U.K. Patent No. 861,138; and U.S. Pat. Nos. 3,632,345; 3,928,041; 3,958,993 and 3,961,959, all of which are incorporated herein by reference.

Specific representative examples of coupler moieties suitable for use in the invention are as follows:

Formula (1A)

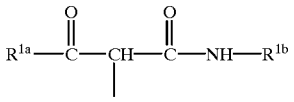

Formula (1B)

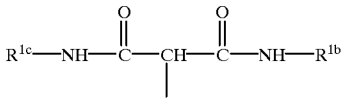

Formula (1C)

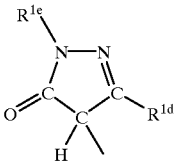

Formula (1D)

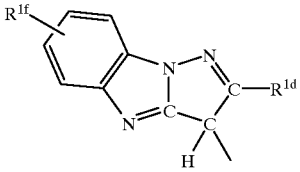

Formula (1E)

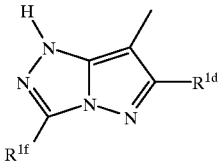

Formula (1F)

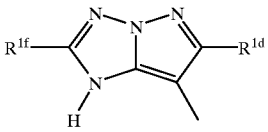

-continued

Formula (1G)

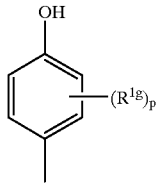

Formula (1H)

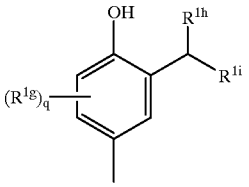

Formula (1I)

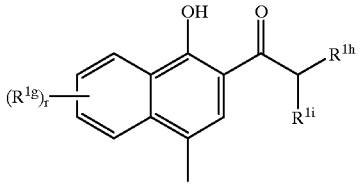

Formula (1J)

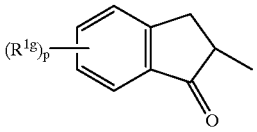

Formula (1K)

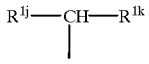

p in the above formulae can be 0 to 4; q can be 0 to 3; and r can be 0 to 5. The free bond in each of the coupler moieties described above represents the coupling site, which is the position to which the coupling-off group is linked. In the above formulae, $R^{1a}$, $R^{1b}$, $R^{1c}$, $R^{1d}$, $R^{1e}$, $R^{1f}$, $R^{1g}$, $R^{1h}$, $R^{1i}$, $R^{1j}$, or $R^{1k}$ may contain one or more solubilizing groups which will enable the coupler, upon reaction with oxidized color developing agent, to washout of the photographic element. Additionally, $R^{1h}$ and $R^{1i}$ can be a hydrogen. Such groups, and couplers containing them, are exemplified in U.S. Pat. Nos. 4,482,629; 5,026,628; 5,151,343; 5,250,398; and 5,250,399, which are incorporated herein by reference. Specifically preferred solubilizing groups are selected from a carboxyl, sulfo, carbonamido or hydroxyl group, or salt thereof. It is preferred that when a solubilizing group is present, the coupler moiety is also unballasted so that complete washing out of the dye can occur. By unballasted, it is meant that each $R^{1a}$ to $R^{1k}$ contain no more than 20 carbon atoms, preferably no more than 12 carbon atoms, and optimally no more than 8 carbon atoms.

$R^{1a}$ to $R^{1k}$, p, q and r in formulae (1A) to (1K) are set forth in more detail as follows. Each of $R^{1a}$ to $R^{1k}$ is independently selected from the group consisting of a substituted or unsubstituted aliphatic, carbocyclic or heterocyclic group. Aliphatic, carbocyclic, and heterocyclic groups as used herein and elsewhere in this specification are defined in accordance with the definitions set forth in Grant and Hackh's *Chemical Dictionary,* fifth ed., McGraw-Hill 1987, and are in accordance with general rules of chemical nomenclature. The following descriptions of exemplary aliphatic, carbocyclic and heterocyclic groups are intended to be utilized throughout this specification unless specifically noted otherwise.

Exemplary aliphatic groups include alkyl, alkene, and alkyne groups, particularly those having 1 to 25 carbon atoms. Examples of useful groups include methyl, ethyl, propyl, butyl, pentyl, hexyl, octyl, nonyl, decyl, dodecyl, hexadecyl, octadecyl, isopropyl, t-butyl, butenyl, pentenyl, hexenyl, octenyl, dodecenyl, propynyl, butynyl, pentynyl, hexynyl, and octynyl.

Exemplary carbocyclic groups (which include aryl groups) are those having a cyclic portion of 4 to 10 carbon atoms. Examples of useful groups include phenyl, tolyl, naphthyl, cyclohexyl, cyclopentyl, cyclohexenyl, cycloheptatrienyl, cyclooctatrienyl, cyclononatrienyl, cyclopentenyl, anilinyl, and anisidinyl.

Exemplary heterocyclic (which include heteroaryl groups) groups are those in which the cyclic portion has 5 to 10 atoms. Examples of useful groups include pyrrolyl, furyl, tetrahydrofuryl, pyridyl, picolinyl, piperidinyl, morpholinyl, thiadiazolyl, thiatriazolyl, benzothiazolyl, benzoxazolyl, benzimidazolyl, benzoselenozolyl, indazolyl, quinolyl, quinaldinyl, pyrrolidinyl, thiophenyl, oxazolyl, thiazolyl, imidazolyl, selenazolyl, tellurazolyl, triazolyl, tetrazolyl, oxadiazolyl, thienyl, pryanyl, chromenyl, isothiazolyl, isoxazolyl, pyrazinyl, pyrimidinyl, pyridazinyl, indolyl, purinyl, isoquinolyl, quinoxalinyl, and quinazolinyl. Preferred heteroatoms are nitrogen, oxygen, and sulfur.

It is understood throughout this specification and claims that any reference to a substituent by the identification of a group or a ring containing a substitutable hydrogen (e.g., alkyl, amine, aryl, alkoxy, heterocyclic, etc.), unless otherwise specifically described as being unsubstituted or as being substituted with only certain substituents, shall encompass not only the substituent's unsubstituted form but also its form substituted with any substituents which do not negate the advantages of this invention. Also, reference to heterocyclic groups includes attachment at any position on the heterocycle. The term lower alkyl used herein means 1 to 5 carbon atoms. The term aryl or heterocyclic group or ring, unless otherwise indicated, includes bicyclic or other fused rings. Groups suitable for substitution, which may themselves be substituted, include, but are not limited to, alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), hydroxy groups, halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups (for example, methylsulfonyl, phenylsulfonyl), carbamoyl and carbonamido groups, ureido groups, sulfamoyl and sulfonamido groups, acyloxy groups (for example, acetoxy, benzoxy), carboxy groups, cyano groups, sulfo groups, nitro groups and amino groups.

Coupler moieties suitable for the couplers utilized in the invention are represented by

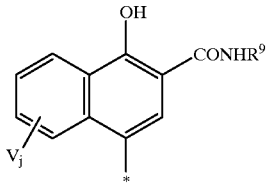

wherein * denotes the coupling site to which $T^1$ is attached.

$R^9$ is selected from hydrogen, or an aliphatic, carbocyclic, or heterocyclic group. In one embodiment this is a wash-out coupler and $R^9$ is preferably hydrogen, an alkyl group containing 1 to 5 carbon atoms, an aryl group containing 6 to 10 carbon atoms or a heterocyclic group containing 4 to 8 carbon atoms. In another embodiment $R^9$ is a ballast group which may contain the above groups.

V is independently selected from an alkyl, heterocyclic, halo, carbamoyl, sulfamoyl, carbonamido, sulfonamido, keto, sulfo, nitro, hydroxyl, carboxyl, amino, alkoxy, alkoxycarbonyl, aryloxy, or arylthio, group; and preferably from an alkyl containing 1 to 5 carbon atoms or a carbamoyl, sulfamoyl, carbonamido, sulfonamido, sulfo, nitro, hydroxyl, carboxyl, amino, alkoxy or alkoxycarbonyl group. j is 0, 1, 2, 3, or 4, preferably 0 or 1.

Also preferred are coupler moieties represented by

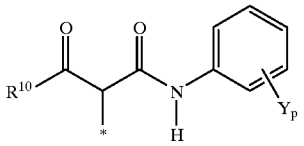

wherein * denotes the coupling site to which $T^1$ is attached.

$R^{10}$ is selected from an aliphatic, carbocyclic, or heterocyclic group; and preferably from an alkyl group containing 1 to 10 carbon atoms, an aryl group containing 6 to 10 carbon atoms or a heterocyclic group containing 4 to 10 atoms;

Y is independently selected from an alkyl, heterocyclic, halo, carbamoyl, sulfamoyl, carbonamido, sulfonamido, keto, sulfo, nitro, hydroxyl, carboxyl, amino, alkoxy, alkoxycarbonyl, aryloxy or arylthio group. In one embodiment the coupler is a wash-out coupler and Y is preferably an alkyl group containing 1 to 5 carbon atoms, carbamoyl, sulfamoyl, carbonamido, sulfonamido, sulfo, nitro, hydroxyl, carboxyl, amino, alkoxy or alkoxycarbonyl group. p is 0, 1, 2, 3, or 4, preferably 1 or 2. In a more preferred embodiment Y is a ballast group which may contain the above groups.

Other preferred coupler moieties are represented by

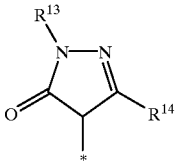

wherein * denotes the coupling site to which $T^1$ is attached.

$R^{13}$ and $R^{14}$ are independently selected from a hydrogen atom, or an aliphatic, carbocyclic, heterocyclic, carbamoyl, sulfamoyl, carbonamido, sulfonamido, acyl, alkylsulfonyl, arylsulfonyl, alkylketo, arylketo, alkoxycarbonyl, aryloxycarbonyl, nitro, cyano, amino, alkoxy, alkoxyalkyl, aryloxy, aryloxyalkyl, thioalkoxy, thioalkoxyalkyl, thioaryloxy, or thioaryloxyalkyl group.

When $R^{14}$ is an amino group, preferred couplers are represented by

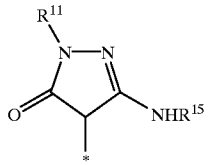

wherein $R^{15}$ an aliphatic, carbocyclic, or heterocyclic group.

In the above image modifying couplers $R^1$ and $R^2$ are independently selected from a halide or hydrogen atom, or an aliphatic, carbocyclic, heterocyclic, carbamoyl, sulfamoyl, carbonamido, sulfonamido, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group or $R^1$ and $R^2$ may form a carbocylic or heterocyclic ring. $R^1$ and $R^2$ may be the same or different. When they are different preferably $R^1$ or $R^2$ is a halide atom or an alkyl or carbocyclic group and the other is as defined below. In one suitable embodiment $R^1$ or $R^2$ is a carbocyclic group having 6 to 10 carbon atoms, and is preferably an aryl group.

Preferably $R^1$ and $R^2$ are independently represented by the formula $$**—(Z)_m-(X)_t-R^3$$

wherein ** represents the point of attachment to the triazole moiety. Z is selected from an aliphatic, carbocyclic, or heterocyclic group. m is an integer from 0 to 10 and more preferably m is 0 or 1. X is oxygen [—O—], sulfenate [—O—S—], sulfinate [—O—S(O)—], sulfate [—O—$SO_2$—], sulfur [—S—], sulfonyl [—$SO_2$—], sulfinyl [—S(O)—], selenium [—Se—], selenonyl [—$SeO_2$—], seleninyl [—Se(O)—], or [—N($R^4$)—]; and t is 0,1 or 2. Preferably X is oxygen, sulfur or [—N($R^4$)—]. $R^3$ and $R^4$ are independently selected from hydrogen, or aliphatic, carbocyclic, heterocyclic groups, or acyl groups. Preferably $R^3$ is an aliphatic group of 1 to 25 carbons, a carbocyclic group of 6 to 10 carbon atoms or a heterocyclic group of 5 to 10 atoms, particularly when t is 0. If $R^3$ is a heterocyclic group it may link through a heteroatom or a carbon atom. In one suitable embodiment $R^3$ is

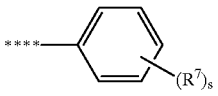

wherein ** represents the point of attachment to —$(Z)_m$—$(X)_t$-****

$R^7$ is an aliphatic, carbocyclic, heterocyclic, carbamoyl, sulfamoyl, carbonamido, sulfonamido, halogen, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group; and s is an integer from 0 to 5.

In one embodiment X is oxygen or [—N($R^4$)—] and $R^3$ is an aliphatic, or carbocyclic group. In another suitable embodiment X is sulfur and $R^3$ is a heterocyclic group. In a further suitable embodiment X is oxygen and $R^3$ is an acyl group. Alternatively t may be 0.

In one preferred embodiment Z is represented by the formula

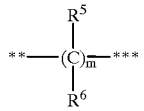

wherein *** represents the point of attachment to $-(X)_t-R^3$. m is preferably 1 or 0. $R^5$ and $R^6$ are independently selected from hydrogen, or aliphatic, carbocyclic, or heterocyclic groups, or $R^1$, $R^3$, $R^4$, $R^5$ and $R^6$ may be bonded together in pairs to form a 5 to 8 membered ring. Preferably $R^5$ and $R^6$ are hydrogen or a lower alkyl group. Again, in a suitable embodiment X is oxygen and $R^3$ is an acyl group or X is sulfur and $R^3$ is a heterocyclic group.

$T^1$, if optionally utilized, can be any timing or linking group known in the art, for instance those described below and in U.S. Pat. Nos. 4,248,962; 4,409,323; 4,421,845; 4,857,447; 4,861,701; 4,864,604; 4,886,736; 4,891,304; 5,034,311; 5,055,385; 5,190,846; and European Patent Application 0 167 168, all of which are incorporated herein by reference. Thus, it may be a timing or linking group which functions by a nucleophilic displacement reaction (of the type described in, for example U.S. Pat. No. 4,248,962) or electron transfer down a conjugated chain (of the type described in, for example, U.S. Pat. No. 4,861,701). It may also be a timing or linking group which functions by electron transfer down an unconjugated chain. These last groups are known in the art under various names. Often they have been referred to as groups capable of utilizing a hemiacetal or iminoketal cleavage reaction or groups capable of utilizing a cleavage reaction due to ester hydrolysis. Regardless of their label, though, their mechanism is that of electron transfer down an unconjugated chain which results, typically, in a relatively fast decomposition and the production of carbon dioxide, formaldehyde or other low molecular weight by-products. Such groups are exemplified specifically in European Patent Application 0 464 612 and 0 523 451, both of which are incorporated herein by reference.

The image modifying couplers can be incorporated in photographic elements by means and processes known in the photographic art. Photographic elements in which the image modifying couplers are incorporated can be simple elements comprising a support and a single silver halide emulsion layer or multilayer, multicolor elements. The couplers can be incorporated in at least one of the light sensitive silver halide emulsion layers. The couplers may also be incorporated in a non-imaging layer or interlayer. The couplers may be contained in more than one layer, including in both imaging and non-imaging layers. In one embodiment the couplers are contained in an interlayer between a light sensitive layer and another light or non-light sensitive layer, such as an adjacent layer, where they will come into reactive association with oxidized color developing agent which has developed silver halide in the emulsion layer. By "in reactive association with" it is meant that the couplers can react or interact with, or come in contact with the developing agent.

The silver halide emulsion layer can contain or have associated with it other photographic couplers such as development inhibitor releasing couplers, including anchimerically assisted development inhibitor releasing couplers, development agent releasing couplers, bleach inhibitor releasing couplers, electron transfer agent releasing couplers, development inhibiting redox releasing couplers, bleach accelerating releasing couplers, dye-forming couplers, colored masking couplers, and/or competing couplers. These other photographic couplers can form dyes of any color and hue or dyes which can wash out of the element during processing. Additionally, the silver halide emulsion layers and other layers of the photographic element can contain addenda conventionally contained in such layers.

A typical multilayer, multicolor photographic element can comprise, preferably in the following order, a support having thereon a red-sensitive silver halide emulsion unit having associated therewith a cyan image dye forming coupler, a green-sensitive silver halide emulsion unit having associated therewith a magenta image dye forming coupler and a blue-sensitive silver halide emulsion unit having associated therewith a yellow image dye forming coupler, at least one of the silver halide emulsion units or another layer having associated therewith an image modifying coupler as described above. Each silver halide emulsion unit can be composed of one or more layers and the various units and layers can be arranged in different locations with respect to one another.

The silver halide emulsions can contain grains of any size and morphology. Thus, the grains may take the form of cubes, octahedrons, cubo-octahedrons, or any of the other naturally occurring morphologies of cubic lattice type silver halide grains. Further, the grains may be irregular such as spherical grains or tabular grains. The light sensitive silver halide emulsions can include coarse, regular or fine grain silver halide crystals or mixtures thereof, in a hydrophobic colloid, such as gelatin. The crystals can be comprised of any silver halide content, including silver chloride, silver bromide, silver bromoiodide, silver chlorobromide, silver chloroiodide, silver chlorobromoiodide and mixtures thereof. The emulsions can be negative-working or positive-working emulsions and can be incorporated into negative or reversal elements as in U.S. Pat. No. 5,411,839, as well as other types of elements known in the art. They can form latent images predominantly on the surface of the silver halide grains or predominantly on the interior of the silver halide grains. They can be chemically and spectrally sensitized by methods known in the art.

The silver halide photographic elements may also contain a transparent magnetic recording layer such as a layer containing magnetic particles on the underside of a transparent support, as described in *Research Disclosure,* November 1992, Item 34390 published by Kenneth Mason Publications, Ltd., Dudley Annex, 12a North Street, Emsworth, Hampshire PO10 7DQ, ENGLAND. Typically, the element will have a total thickness (excluding the support) of from about 5 to about 30 microns. Further, the photographic elements may have an annealed polyethylene naphthalate film base such as described in Hatsumei Kyoukai Koukai Gihou No. 94-6023, published Mar. 15, 1994 (Patent Office of Japan and Library of Congress of Japan) and may be utilized in a small format system, such as described in *Research Disclosure,* June 1994, Item 36230 published by Kenneth Mason Publications, Ltd., Dudley Annex, 12a North Street, Emsworth, Hampshire PO10 7DQ, ENGLAND, and such as the Advanced Photo System, particularly the Kodak ADVANTIX films or cameras.

In the following Table, reference will be made to (1) *Research Disclosure,* December 1978, Item 17643, (2) *Research Disclosure,* December 1989, Item 308119, and (3) *Research Disclosure,* September 1994, Item 36544, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. Photographic elements and methods of processing such elements particularly suitable for use with this invention are described in *Research Disclosure,* February 1995, Item 37038, published by Kenneth Mason Publications, Ltd., Dudley Annex, 12a North Street, Emsworth, Hampshire PO10 7DQ, ENGLAND, the disclosure of which is incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation including hardeners, coating |
| 3 | I, II, III, IX A & B | aids, addenda, etc. |
| 1 | III, IV | Chemical sensitization and |
| 2 | III, IV | spectral sensitization/ |
| 3 | IV, V | desensitization |
| 1 | V | UV dyes, optical brighteners, |
| 2 | V | luminescent dyes |
| 3 | VI | |
| 1 | VI | Antifoggants and stabilizers |
| 2 | VI | |
| 3 | VII | |
| 1 | VIII | Absorbing and scattering |
| 2 | VIII, XIII, XVI | materials; Antistatic layers; matting agents |
| 3 | VIII, IX C & D | |
| 1 | VII | Image-couplers and image- |
| 2 | VII | modifying couplers; Wash- |
| 3 | X | out couplers; Dye stabilizers and hue modifiers |
| 1 | XVII | Supports |
| 2 | XVII | |
| 3 | XV | |
| 3 | XI | Specific layer arrangements |
| 3 | XII, XIII | Negative working emulsions; Direct positive emulsions |
| 2 | XVIII | Exposure |
| 3 | XVI | |
| 1 | XIX, XX | Chemical processing; |
| 2 | XIX, XX, XXII | Developing agents |
| 3 | XVIII, XIX, XX | |
| 3 | XIV | Scanning and digital processing procedures |

The photographic elements can be incorporated into exposure structures intended for repeated use or exposure structures intended for limited use, variously referred to as single use cameras, lens with film, or photosensitive material package units.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements.

The photographic elements are preferably exposed to actinic radiation, typically in the visible region of the spectrum, to form a latent image, and then processed to form a visible dye image. Development is typically followed by the conventional steps of bleaching, fixing, or bleach-fixing, to remove silver or silver halide, washing, and drying.

The following examples illustrate the practice of the invention. They are intended to be illustrative, and should not be construed as limiting the invention to the specific embodiments disclosed.

EXAMPLES

Example 1

The photographic elements were prepared by coating the following layers on a cellulose acetate film support (amounts of each component are indicated in mg/m$^2$):

Emulsion layer 1: (RECEIVER LAYER)

Gelatin-2420

Red sensitized silver bromoiodide (as Ag)-1615

Magenta image coupler (Ma-1)-557 dispersed in tritolyl phosphate.

Interlayer

Gelatin-860

Didodecylhydroquinone-113

Emulsion layer 2: (CAUSER LAYER)

Gelatin-2690

Green sensitized silver bromoiodide (as Ag)-1615

Yellow image coupler (Ye-1)-694 dispersed in dibutyl phthalate

DIR coupler of Tables 1 and 2 dispersed in tritolyl phosphate.

Protective Overcoat

Gelatin-5380

Bisvinylsulfonylmethyl ether at 2% total gelatin.

The structures of the couplers utilized in the Examples are as follows:

Magenta Image Coupler, Ma-1:

Magenta Image Coupler, Ma-1:

Ma-1

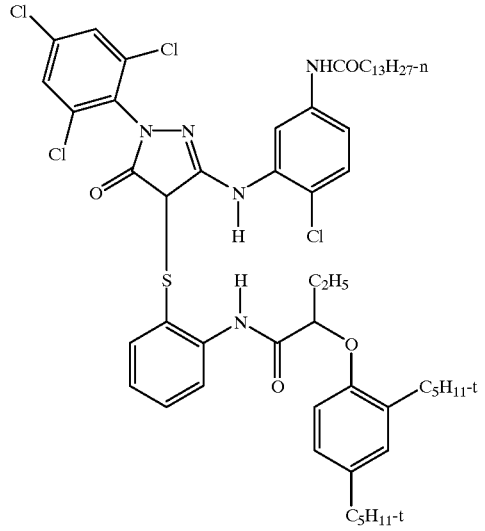

-continued
Yellow Image Coupler, Ye-1:
Ye-1
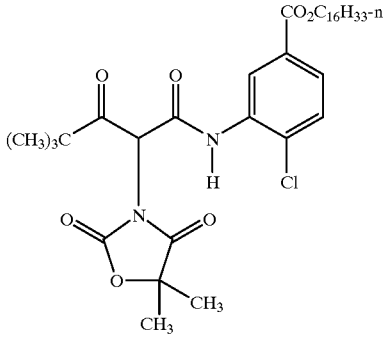
Yellow DIR Coupler, D-1:
D-1
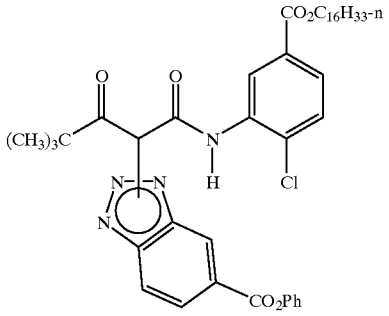
Yellow DIR Coupler, D-2:
D-2
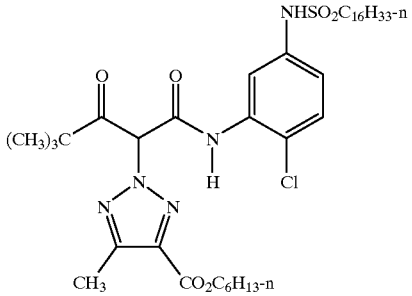
Yellow DIR Coupler, I-1:
I-1
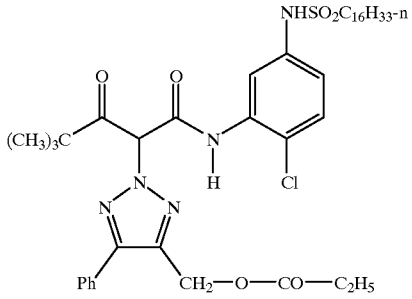
-continued
Yellow DIR Coupler, I-2:
I-2
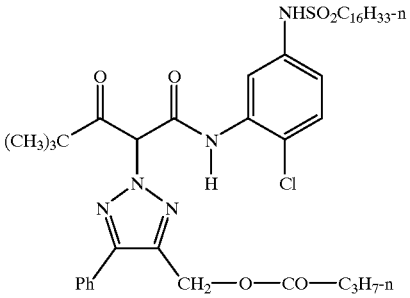
Yellow DIR Coupler, I-3:
I-3
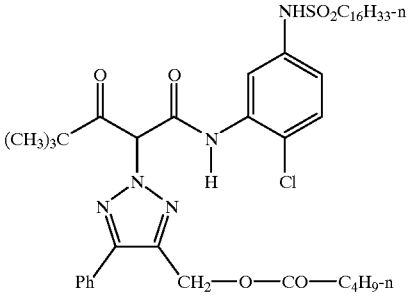
Yellow DIR Coupler, I-4:
I-4
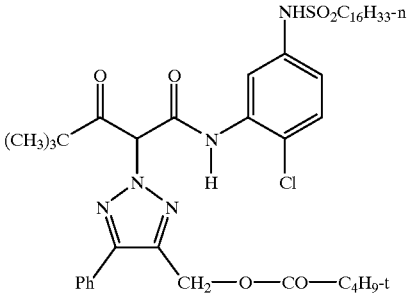
Yellow DIR Coupler, I-5:
I-5
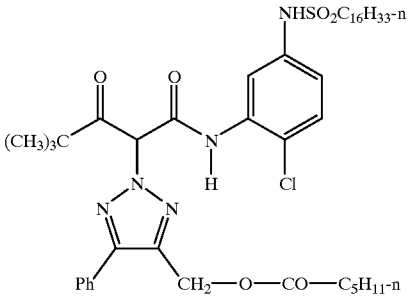

-continued
Yellow DIR Coupler, I-6:
I-6
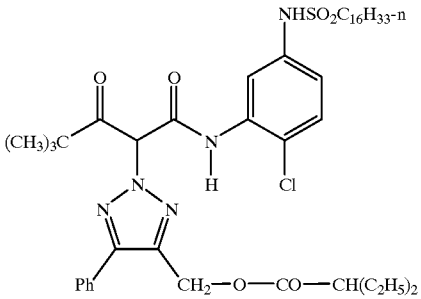
Yellow DIR Coupler, I-7:
I-7
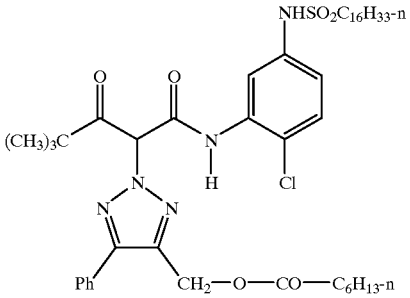
Yellow DIR Coupler, I-8
I-8
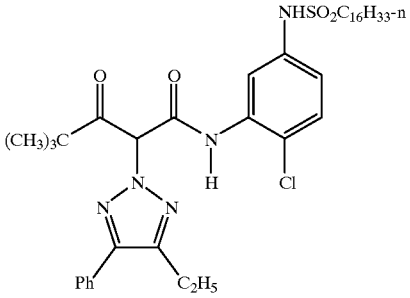
Yellow DIR Coupler, I-9:
I-9
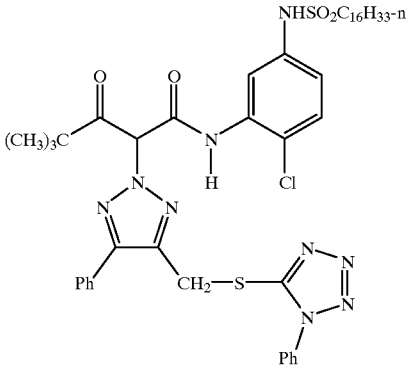
-continued
Yellow DIR Coupler, I-10:
I-10
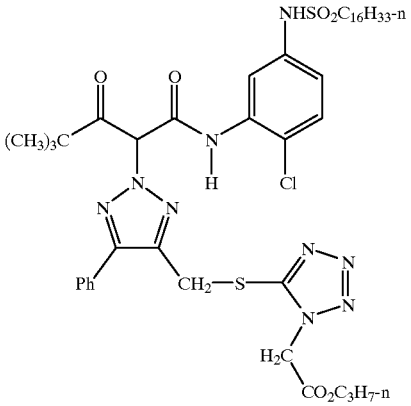
Yellow DIR Coupler, I-11:
I-11
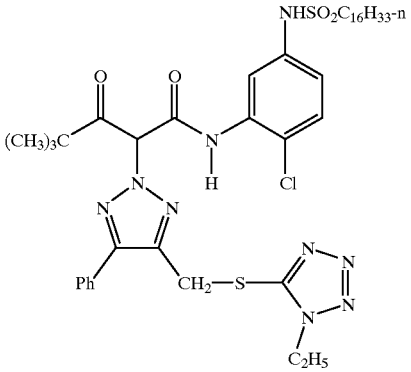
Yellow DIR Coupler, I-12:
I-12
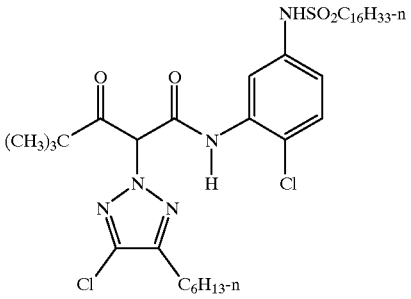
Yellow DIR Coupler, I-13:
I-13
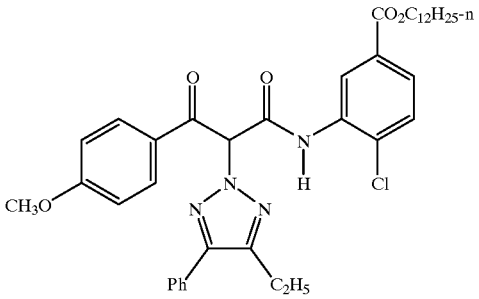

-continued

Magenta DIR Coupler, I-14:

I-14

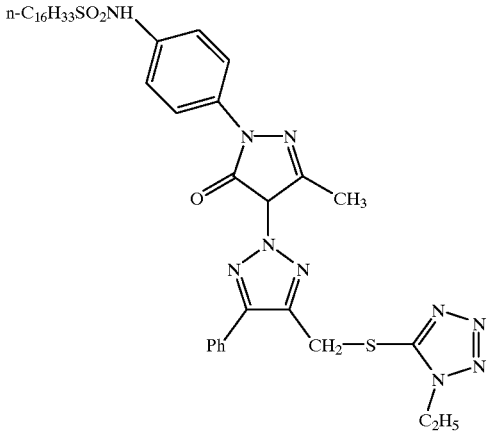

Magenta DIR Coupler, I-15:

I-15

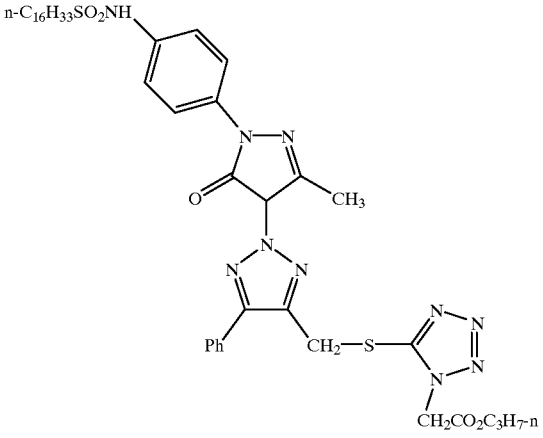

Magenta DIR Coupler, I-16:

I-16

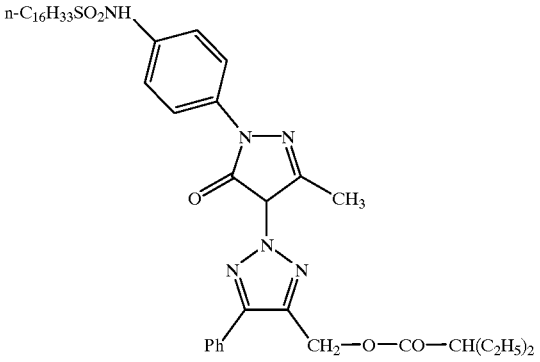

Strips of each element were exposed to a green or white light through a graduated density step tablet, or through a 35% modulation fringe chart for sharpness measurements, and then developed for 3.25 minutes at 38° C. in the following color developer. Development was then stopped, and the elements were washed, bleached, fixed, and dried.

Color Developer

| | | |
|---|---|---|
| Distilled water | 800 | mL |
| Sodium Sulfite, anhydrous | 0.38 | g |
| CD-4 (color developer)* | 4.52 | g |
| Potassium Carbonate, anhyd. | 34.3 | g |
| Potassium Bicarbonate | 2.32 | g |
| Sodium Bromide | 1.31 | g |
| Potassium Iodide | 1.20 | mg |
| Hydroxylamine Sulfate | 2.41 | g |
| Diethylenetriaminepentacetic acid, pentasodium salt 40% Soln.) | 8.43 | g |
| Distilled water | to | 1L |
| Adjust pH to 10.0 | | |

*CD-4 is a KODAK color developer in which the active component is 4-amino-3-methyl-N-ethyl-N-beta-hydroxy-ethylaniline sulfate.

Photographic effects were determined as follows: To determine acutance(AMT), a series of elements as described above containing no DIR coupler or varying levels of DIR coupler were exposed with green light. The contrast ($\gamma$) along the straight line portion of each elements' D log H curve was measured. A plot of log($\gamma$) versus amount of DIR coupler ($\mu$moles) was made for each element (each element containing a different DIR coupler). From these plots, the amount of DIR coupler needed to achieve log($0.7\gamma_o$) was read, where $\gamma_o$ represented the contrast of the element containing no DIR coupler. This value was recorded in Table 1 as Level* (* amount of DIR coupler need to reduce the contrast by 30%). In the same experiment, a plot of acutance versus log($\gamma$) was made for each element and from this plot the acutance at position log($0.7\gamma_o$) was read. These acutance values are shown in Table 1.

Acutance, as measured by AMT values and recorded in Table 1, are calculated using the following formula in which the cascaded area under the system modulation curve is shown in equation (21.104) on page 629 of the "Theory of the Photographic Process", 4th Edition, 1977, edited by T. H. James: AMT=100+66Log[cascaded area/2.6696M] wherein the magnification factor M is 3.8 for the 35 mm system AMT. The use of CMT acutance is described by R. G. Gendron in "An Improved Objective Method of Rating Picture Sharpness: CMT acutance" in the Journal of SMPTE, Vol. 82, pages 1009–12, (1973). AMT is a further modification of CMT useful for evaluating systems which include the viewing of a positive print made from a negative.

Interlayer interimage effects representing the degree of color correction capable of being obtained by practice of the invention were evaluated after the same series of photographic elements were exposed to a white light. The log of the causer contrast($\gamma_c$) and the log of the receiver contrast ($\gamma_r$) were read for each of the DIR levels in the elements and a plot of log($\gamma_c$) versus log($\gamma_r$) was made. From this plot, ($\gamma_r$) was determined at log($0.7\gamma_o$), where log ($0.7\gamma_o$) was measured along the causer axis in the plot. The ratio ($\gamma_c$)/($\gamma_r$) was recorded in Table 1 as Interlayer Interimage.

TABLE 1

| DIR Coupler | Level* ($\mu$/m$^2$) | Interlayer Interimage ($\gamma_c/\gamma_r$) | Accutance (35 mm/causer) |
|---|---|---|---|
| D-1 | 117.7 | 0.68 | 91.4 |
| I-1 | 288.9 | 1.35 | 92.4 |
| I-2 | 230.1 | 0.95 | 93.0 |
| I-3 | 85.6 | 0.72 | 92.4 |
| I-4 | 160.5 | 0.82 | 93.0 |
| I-6 | 74.9 | 0.61 | 92.0 |

*Amount of DIR coupler coated that is needed to reduce contrast 30%

It can be seen from Table 1 that the couplers of the invention give accutance and/or interlayer interimage effects superior to those of the control coupler D-1.

Example 2

The photographic elements of Example 2 were prepared and processed, and the results measured and calculated, as described for Example 1. The results are shown in Table 2.

TABLE 2

| DIR Coupler | Level* ($\mu/m^2$) | Interlayer Interimage ($\gamma_c/\gamma_t$) | Accutance (35 mm/causer) |
|---|---|---|---|
| D-1 | 107 | 0.659 | 92.0 |
| D-2 | 69.6 | 0.659 | 92.8 |
| I-5 | 53.5 | 0.596 | 92.0 |
| I-6 | 85.6 | 0.757 | 92.8 |
| I-8 | 112.4 | 0.659 | 92.8 |
| I-9 | 37.5 | 0.560 | 91.0 |
| I-10 | 107.0 | 0.830 | 94.0 |
| I-12 | 69.6 | 0.629 | 92.0 |
| I-13 | 128.4 | 0.830 | 94.0 |

*Amount of DIR coupler coated that is needed to reduce contrast 30%

It can be seen from Table 2 that the couplers of the invention give accutance, interlayer interimage effects and/or activity (amount of DIR coated), superior to those of control couplers D-1 and D-2.

Example 3

Strips of the photographic elements of Examples 1 and 2 were stored and incubated for 4 weeks at 49° C. and 50% relative humidity. The stability of the couplers utilized in the invention and the comparative couplers is shown in Table 3 as % loss. Specifically, % loss was determined by extracting the coupler from the elements after incubation and comparing the amount (weight) of coupler extracted with the amount (weight) extracted from similar elements that were not incubated. Extraction was performed by methods known in the art and measurements of coupler amounts were made by HPLC analysis.

| DIR Coupler | % Loss** | DIR Coupler | % Loss** |
|---|---|---|---|
| D-1 | 1 | I-8 | 0 |
| D-2 | 28 | I-9 | 4 |
| I-1 | 5 | I-10 | 3 |
| I-2 | 3 | I-12 | 0 |
| I-3 | 5 | I-13 | 13 |
| I-4 | 9 | I-14 | 6 |
| I-5 | 8 | I-15 | 4 |
| I-6 | 5 | I-16 | 1 |
| I-7 | 6 | | |

**% loss of the coupler from the photographic elements after 4 weeks at 49° C. and 50% relative humidity.

It can be seen from Table 3 that the couplers utilized in this invention have superior stability when stored under tropical conditions. It can also be seen from Tables 1, 2 and 3 that while couplers D-1 and D-2 show single advantages such as having either good accutance or good stability; the couplers of the invention show multiple advantages, i.e. they demonstrate good accutance, interimage effects and stability.

Example 4

The photographic element was prepared by coating the following layers on a film support with a grey silver antihalation layer (amounts of each component are indicated in $mg/m^2$):

Emulsion Layer 1; (RECEIVER LAYER) Gelatin-2688. Red sensitized silver bromoiodide (as Ag)-806. Magenta Image Coupler (Ma-1 ):tritolyl phosphate:Stabilizer (ST-1), in the ratio 1.0:0.8:0.2 (respectively)-430

INTERLAYER LAYER Gelatine-860. Interlayer Scavenger (S-1)-54.

Emulsion Layer 2: (CAUSER LAYER) Gelatin-2688. Green sensitized silver bromoiodide (as Ag)-806. Yellow Image Coupler (Ye-1)-860, dispersed in tritolyl phosphate (1:0.5), and DIR Couplers I-17, I-18, I-19, I-20 and I-23 of Table 4 dispersed in tritolyl phosphate.

PROTECTIVE OVERCOAT Gelatin-5375. Bisvinylsulfonylmethyl ether-281.

The elements were subjected to a green exposure and a neutral exposure and processed by bleaching and fixing as described in Example 1. The blue contrast was read for the green exposure (B of G), and green contrast read for the neutral exposure (G of N). The results are shown in Table 4.

TABLE 4

| Entry No. | DIR Coupler | Level (mmoles/sq. m) | % Contrast Reduction (B of G)[1] Causer Layer | % Contrast Reduction (G of N)[2] Receiver Layer |
|---|---|---|---|---|
| 1 (control) | none | 0 | 0 | 0 |
| 2 (check) | D-1 | 54 | −22 | −4 |
| | | 108 | −27 | −10 |
| | | 161 | −34 | −21 |
| 3 | I-17 | 54 | −13 | −17 |
| | | 108 | −18 | −27 |
| | | 161 | −22 | −36 |
| 4 | I-18 | 54 | −26 | −21 |
| | | 108 | −43 | −39 |
| | | 161 | −60 | −40 |
| 5 | I-19 | 54 | −54 | −29 |
| | | 108 | −69 | −43 |
| | | 161 | −74 | −49 |
| 6 | I-20 | 54 | −17 | −22 |
| | | 108 | −27 | −36 |
| | | 161 | −41 | −43 |
| 7 | I-23 | 54 | −29 | −18 |
| | | 108 | −42 | −32 |
| | | 161 | −49 | −39 |

[1]Blue contrast obtained from a green only exposure.
[2]Green contrast obtained from a neutral exposure. This is a measure of the Interlayer Interimage of the element.

Example 5

The photographic element was prepared by coating the following layers on a film support with a grey silver antihalation layer (amounts of each component are indicated in $mg/m^2$):

Emulsion Layer 1; (RECEIVER LAYER) Gelatin-2688. Red sensitized silver bromoiodide (as Ag)-806. BAR Coupler (B-1)-5. DIR Coupler (D-3)-22. Cyan Image Coupler (C-1)-753, dispersed in dibutylphthalate INTERLAYER LAYER Gelatine-860. Interlayer Scavenger (S-1)-54.

Emulsion Layer 2; (CAUSER LAYER) Gelatin-2688. Green sensitized silver bromoiodide (as Ag)-806. Magenta Image Coupler (Ma-1):tritolyl phosphate:Stabilizer (ST-1) in the ratio 1.0:0.8:0.2 (respectively)-430 and DIR Couplers I-25 and I-27 of Table 5 dispersed in tritolyl phosphate.

PROTECTIVE OVERCOAT Gelatin-5375. Bisvinylsulfonylmethyl ether-281.

The elements were subjected to a green exposure and a neutral exposure and processed by bleaching and fixing as described in Example 1. The green contrast was read for the green exposure (G of G), and red contrast read for the neutral exposure (R of N).

The results of the experiment are shown in Table 5.

TABLE 5

| Entry No. | DIR Coupler | Level (mmoles/sq. m) | % Contrast Reduction (G of G)[1] Causer Layer | % Contrast Reduction (R of N)[2] Receiver Layer |
|---|---|---|---|---|
| 8 (control) | none | 0 | 0 | 0 |
| 9 | I-25 | 54 | −32 | −32 |
| | | 108 | −45 | −38 |
| | | 161 | −49 | −40 |
| 10 | I-27 | 54 | −42 | −22 |
| | | 108 | −52 | −29 |

[1]Green contrast obtained from a green only exposure.

[2]Red contrast obtained from a neutral exposure. This is a measure of the Interlayer Interimage of the element.

It can be seen from Tables 4 and 5 that in comparison to the check D-1; the compounds of the invention are very effective at reducing the contrast in not only the causer layer, but also in the receiver layer.

The structures of the couplers and compounds utilized in Examples 4 and 5 are as follows:

Stabilizer, ST-1:

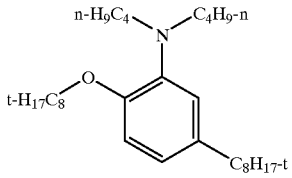

Interlayer Scavenger, S-1:

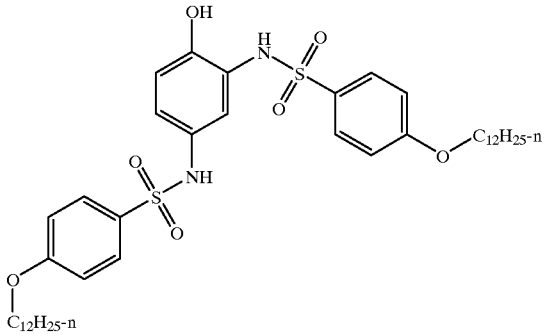

Cyan Image Coupler, C-1:

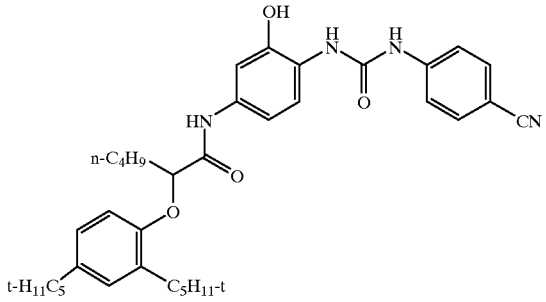

-continued

BAR Coupler, B-1:

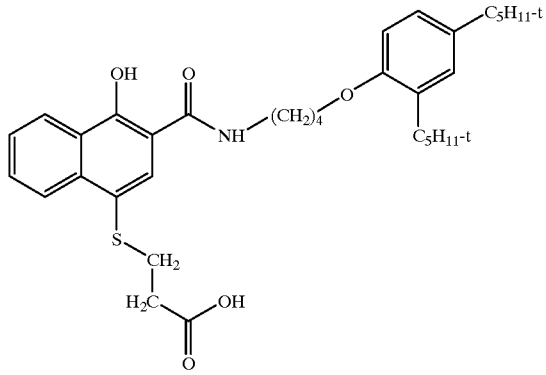

DIR Coupler, D-3

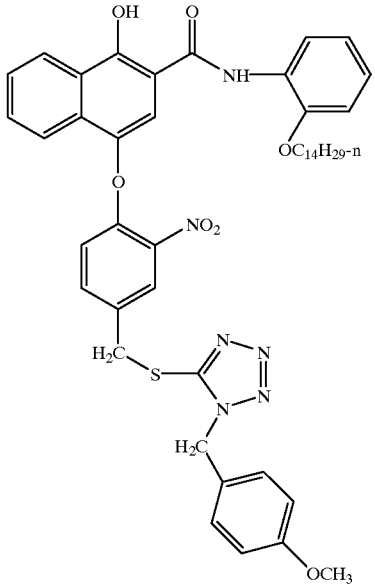

DIR Coupler I-17

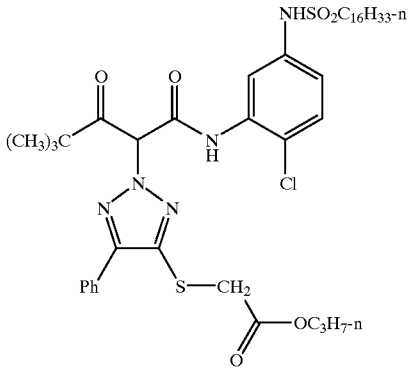

-continued
DIR Coupler I-18
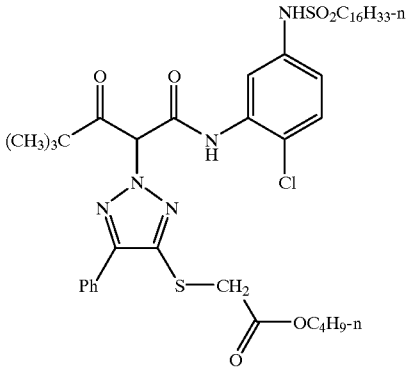
DIR Coupler I-19
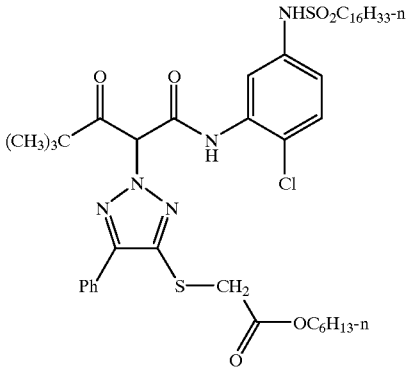
DIR Coupler I-20
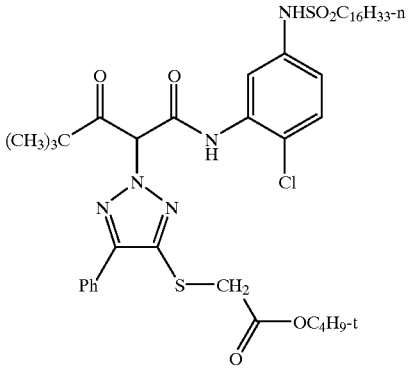
DIR Coupler I-21
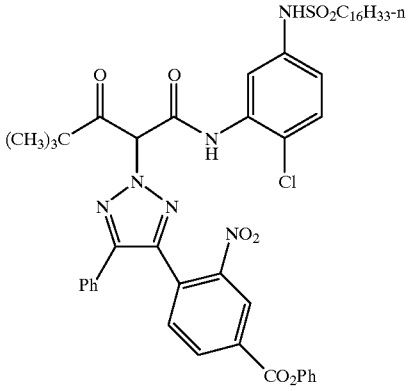
-continued
DIR Coupler I-22
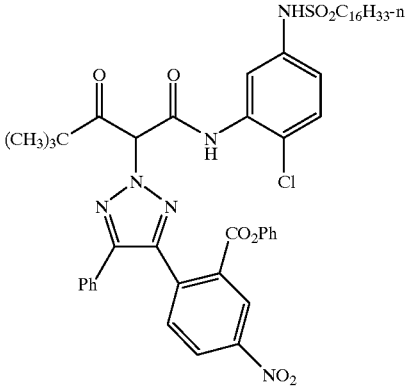
DIR Coupler I-23
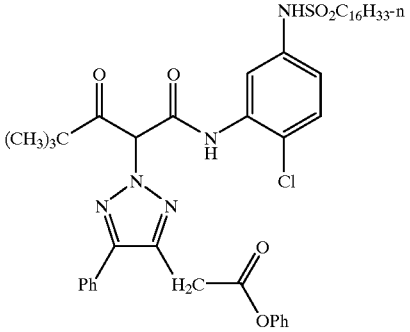
DIR Coupler I-24
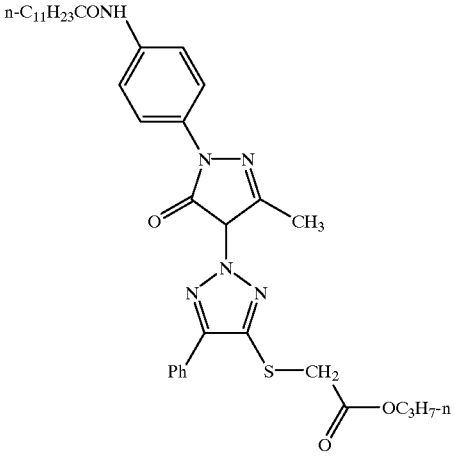

-continued

DIR Coupler I-25

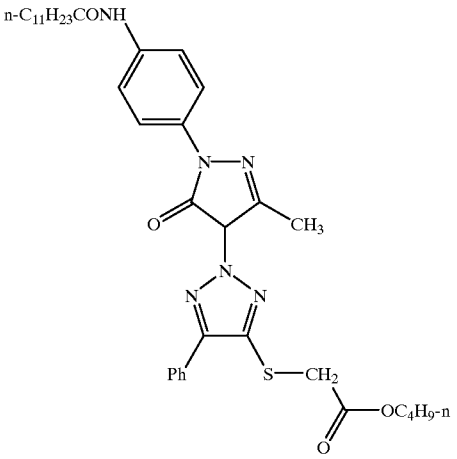

DIR Coupler I-26

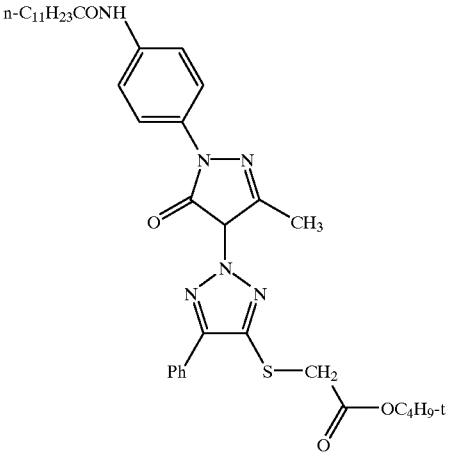

DIR Coupler I-27

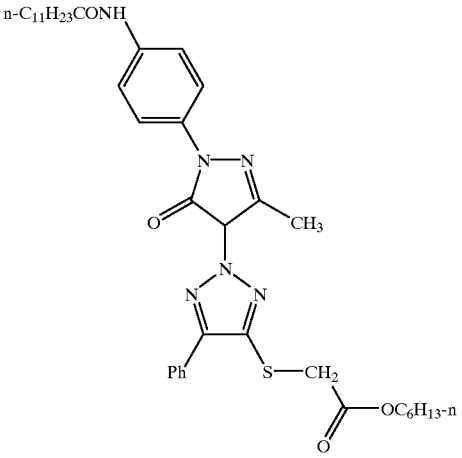

-continued

DIR Coupler I-28

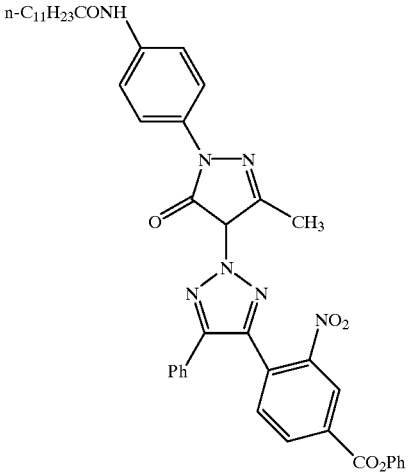

DIR Coupler I-29

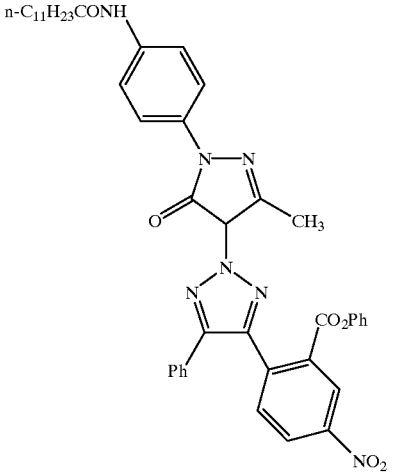

The invention has been described in detail with particular reference to preferred embodiments thereof, but it will be understood that variations and modifications can be effected within the spirit and scope of the invention.

What is claimed is:

1. A photographic element comprising a support having situated thereon at least one silver halide emulsion layer, the element further containing an image modifying coupler which upon reaction with oxidized color developing agent during processing forms a dye, said image modifying coupler represented by the formula

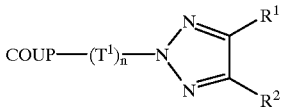

wherein

COUP is a photographic coupler moiety;

$T^1$ is a timing or linking group;

$R^1$ and $R^2$ are independently selected from a halide atom, or an aliphatic, carbocyclic, heterocyclic, carbamoyl, sulfamoyl, carbonamido, sulfonamido, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group; and n is selected from 0, 1 or 2.

2. The photographic element of claim 1 wherein $R^1$ and $R^2$ are independently represented by the formula:

$$^{**}\text{—}(Z)_m\text{-}(X)_t\text{-}R^3$$

** point of attachment to triazole moiety wherein:

Z is an aliphatic, carbocyclic, or heterocyclic group;

X is oxygen, sulfenate, sulfinate, sulfate, sulfur, sulfonyl, sulfinyl, selenium, selenonyl, seleninyl, or [—N($R^4$)—]; and $R^3$ and $R^4$ are independently selected from hydrogen, or aliphatic, carbocyclic, heterocyclic groups, or acyl groups;

m is an integer from 0 to 10; and t is 0, 1 or 2.

3. The photographic element of claim 2 wherein n is 0.

4. The photographic element of claim 3 wherein for at least one of $R^1$ or $R^2$ t is 0, m is 0 and $R^3$ is an aliphatic or carbocyclic group.

5. The photographic element of claim 4 wherein $R^3$ is an aryl group.

6. The photographic element of claim 3 wherein for at least one of $R^1$ or_$R^2$ X is oxygen, sulfur or nitrogen.

7. The photographic element of claim 6 wherein for at least one of $R^1$ or_$R^2$ X is oxygen or —N($R^4$)— and $R^3$ is an aliphatic, or carbocyclic group and $R^4$ is hydrogen or an aliphatic, carbocyclic, heterocyclic or acyl group.

8. The photographic element of claim 6 wherein for at least one of $R^1$ or_$R^2$ X is sulfur and $R^3$ is a heterocyclic group.

9. The photographic element of claim 6 wherein for at least one of $R^1$ or_$R^2$ X is oxygen and $R^3$ is an acyl group.

10. The photographic element of claim 3 wherein for at least one of $R^1$ or_$R^2$ Z is represented by the formula

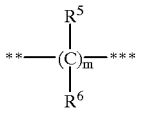

*** point of attachment to $-(X)_t-R^3$ wherein $R^5$ and $R^6$ are independently selected from hydrogen, or aliphatic, carbocyclic, or heterocyclic groups, or $R^1$, $R^3$, $R^4$, $R^5$ and $R^6$ may be bonded together in pairs to form a 5 to 8 membered ring.

11. The photographic element of claim 3 wherein for at least one of $R^1$ or $R^2$ m is 0 or 1.

12. The photographic element of claim 10 wherein m is 0 or 1.

13. The photographic element of claim 10 wherein X is oxygen and $R^3$ is an acyl group.

14. The photographic element of claim 10 wherein X is sulfur and $R^3$ is a heterocyclic group.

15. The photographic element of claim 3 wherein for at least one of $R^1$ or $R^2$ t is 0.

16. The photographic element of claim 10 wherein $R^3$ is an aliphatic group of 1 to 25 carbons, a carbocyclic group of 6 to 10 carbon atoms or a heterocyclic group of 5 to 10 atoms.

17. The photographic element of claim 16 wherein $R^3$ is

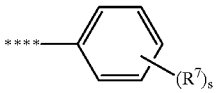

** represents the point of attachment to $^{}\text{-}(Z)_m\text{-}(X)_t\text{-}^{****}$ wherein $R^7$ is an aliphatic, carbocyclic, heterocyclic, carbamoyl, sulfamoyl, carbonamido, sulfonamido, halogen, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group; and s is an integer from 0 to 5.

18. The photographic element of claim 10 wherein t is 0.

19. The photographic element of claim 16 wherein t is 0.

20. The photographic element of claim 3 wherein the image modifying coupler is contained in a light-sensitive silver halide emulsion layer.

21. The photographic element of claim 3 wherein the image modifying coupler is located in an interlayer between two light-sensitive silver halide emulsion layers.

22. The photographic element of claim 20 wherein the silver halide emulsion layer contains a development inhibitor releasing coupler in addition to the image modifying coupler.

23. The photographic element of claim 22 wherein the development inhibitor releasing coupler is an anchimerically assisted development inhibitor releasing coupler.

24. The photographic element of claim 20 wherein the silver halide emulsion layer contains a bleach accelerator releasing coupler in addition to the image modifying coupler.

25. The photographic element of claim 1 comprising a support bearing at least one red sensitive photographic silver halide emulsion layer comprising at least one cyan image dye-forming coupler;

at least one green sensitive photographic silver halide emulsion layer comprising at least one magenta image dye-forming coupler;

at least one blue sensitive photographic silver halide emulsion layer comprising at least one yellow image dye-forming coupler; and wherein the image modifying compound is in reactive association with a light-sensitive photographic silver halide emulsion layer.

26. A photographic image modifying coupler represented by the formula

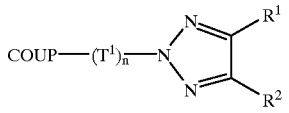

wherein

COUP is a photographic coupler moiety;

$T^1$ is a timing or linking group;

$R^1$ and $R^2$ are independently selected from a halide or hydrogen atom, or an aliphatic, carbocyclic, heterocyclic, carbamoyl, sulfamoyl, carbonamido, sulfonamido, acyl, sulfo, nitro, cyano, amino, alkoxy, alkoxyalkyl, aryloxy, aryloxyalkyl, thioalkoxy, thioalkoxyalkyl, thioaryloxy, or thioaryloxyalkyl group or $R^1$ and $R^2$ may form a carbocylic or heterocyclic ring; and n is 0, 1 or 2.

27. The photographic image modifying coupler of claim 26 wherein $R^1$ and $R^2$ are independently represented by the formula:

$$^{**}\text{—}(Z)_m\text{-}(X)_t\text{-}R^3$$

** point of attachment to triazole moiety wherein;

Z is an aliphatic, carbocyclic, or heterocyclic group;

X is oxygen, sulfenate, sulfinate, sulfate, sulfur, sulfony, sulfinyl, selenium, selenonyl, seleninyl, or [—N($R^4$)—]; and $R^3$ and $R^4$ are independently selected from hydrogen, or aliphatic, carbocyclic, heterocyclic groups, or acyl group;

m is an integer from 0 to 10; and t is 0, 1 or 2.

28. The photographic element of claim 2 wherein m is 0, X is sulfur, t is 1 and $R^3$ is a substituted aliphatic group.

29. The photographic element of claim 2 wherein m is 0, t is 0 and $R^3$ is a substituted aliphatic or substituted carbocyclic group.

30. The photographic element of claim 2 wherein said image modifying coupler is DIR Coupler I-17

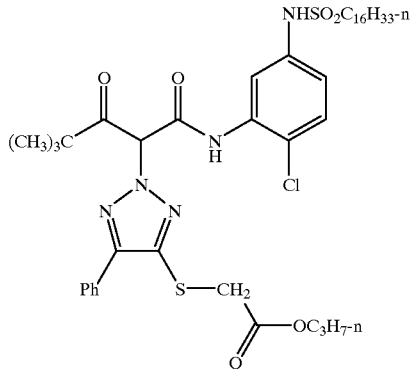

DIR Coupler I-18

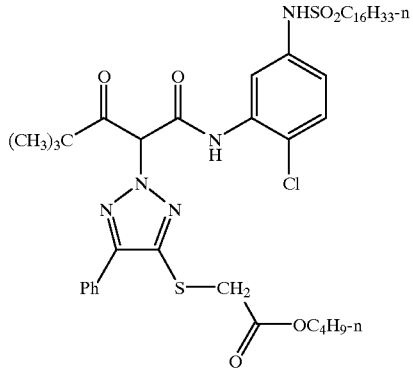

DIR Coupler I-19

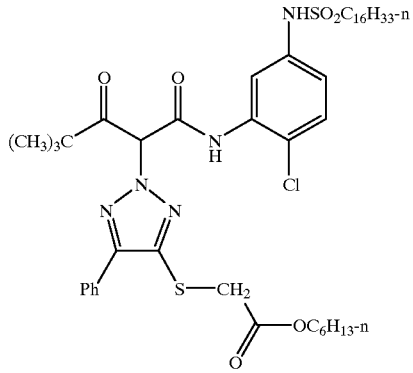

DIR Coupler I-20

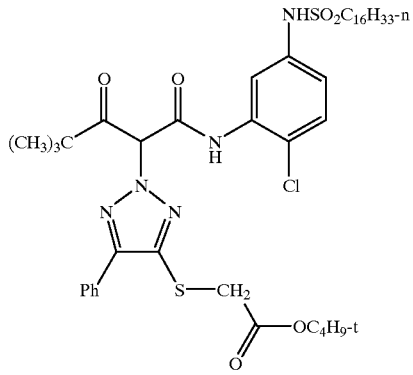

-continued
DIR Coupler I-21
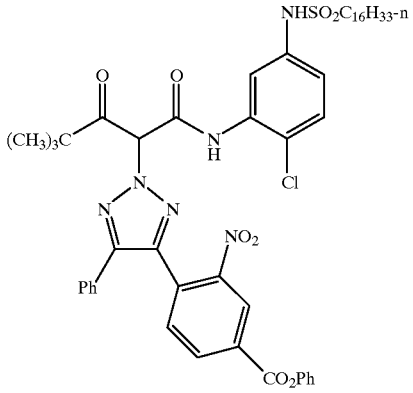
DIR Coupler I-22
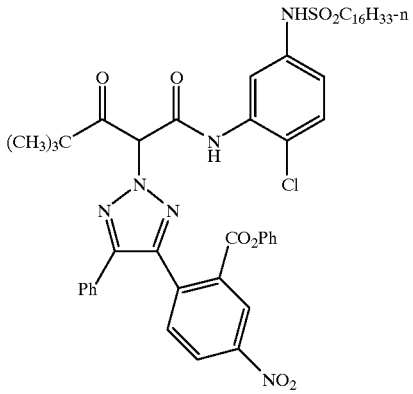
DIR Coupler I-23
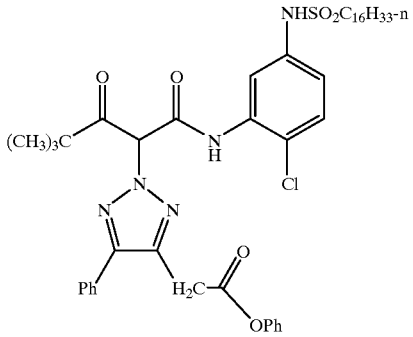
DIR Coupler I-24
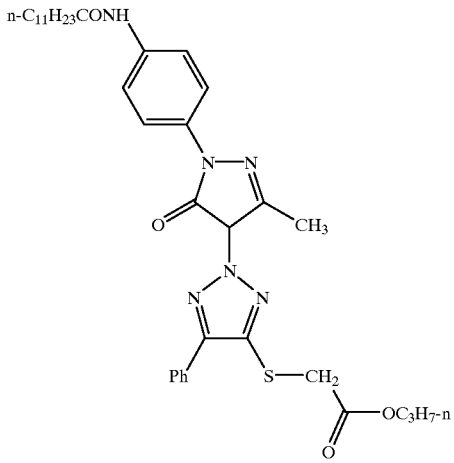
-continued
DIR Coupler I-25
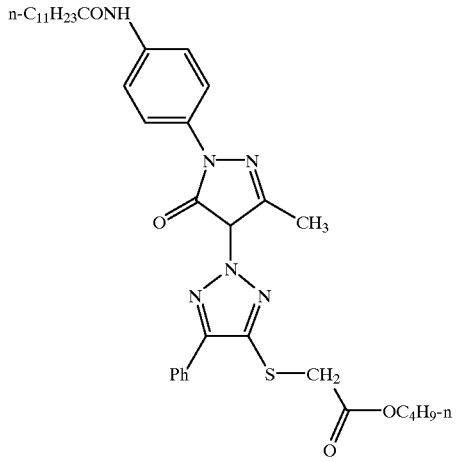
DIR Coupler I-26
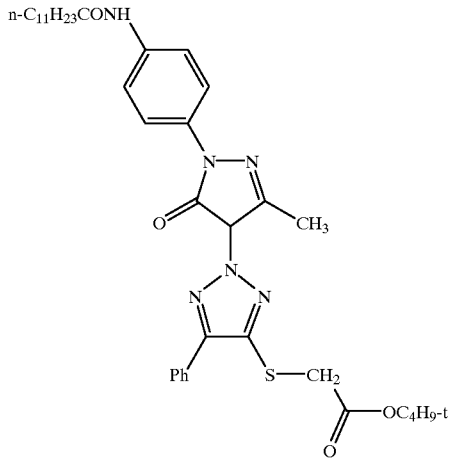
DIR Coupler I-27
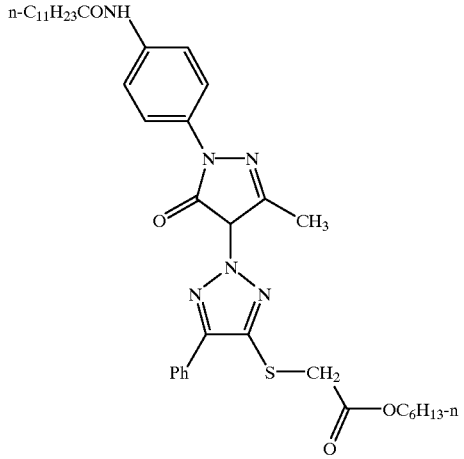

-continued
DIR Coupler I-28
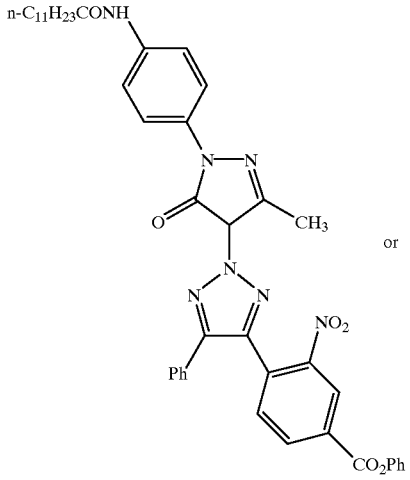
or
-continued
DIR Coupler I-29
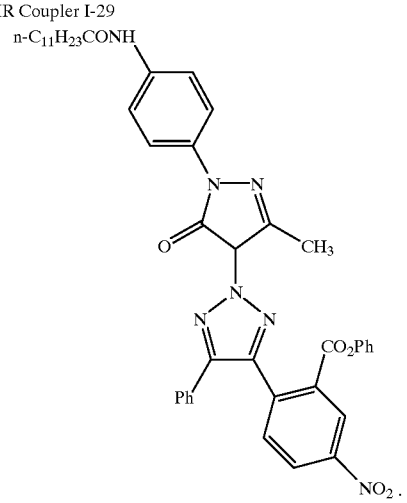
.
* * * * *